US010187734B2

(12) United States Patent
Kvist et al.

(10) Patent No.: US 10,187,734 B2
(45) Date of Patent: Jan. 22, 2019

(54) HEARING AID WITH AN ANTENNA

(71) Applicant: GN Hearing A/S, Ballerup (DK)

(72) Inventors: Soren Kvist, Vaerlose (DK); Sinasi Ozden, Rodovre (DK)

(73) Assignee: GN Hearing A/S, Ballerup (DK)

( * ) Notice: Subject to any disclaimer, the term of this patent is extended or adjusted under 35 U.S.C. 154(b) by 186 days.

(21) Appl. No.: 14/462,474

(22) Filed: Aug. 18, 2014

(65) Prior Publication Data

US 2016/0050502 A1 Feb. 18, 2016

(30) Foreign Application Priority Data

Aug. 15, 2014 (DK) ..... 2014 70487
Aug. 15, 2014 (EP) ..... 14181151

(51) Int. Cl.
*H04R 25/00* (2006.01)

(52) U.S. Cl.
CPC ..... *H04R 25/556* (2013.01); *H04R 25/554* (2013.01); *H04R 2225/51* (2013.01)

(58) Field of Classification Search
CPC .. H04R 25/556; H04R 25/554; H04R 25/552; H04R 25/55; H04R 2225/51; H01Q 1/243; H01Q 1/273
See application file for complete search history.

(56) References Cited

U.S. PATENT DOCUMENTS 6,404,395 B1 * 6/2002 Masuda ..... H01Q 1/243 343/700 MS
6,684,085 B1 1/2004 Haruyama
6,903,693 B1 * 6/2005 Lee ..... H01Q 9/0421 343/700 MS
8,803,760 B2 * 8/2014 Chakam ..... H01Q 1/3241 343/741
2004/0080458 A1 * 4/2004 Sekine ..... H01Q 1/243 343/702

(Continued)

FOREIGN PATENT DOCUMENTS

EP 2 458 674 A2 5/2012
EP 2458674 * 5/2012

(Continued)

OTHER PUBLICATIONS

Extended European Search Report dated Feb. 12, 2015, for corresponding EP Patent Application No. 14181151.3, 6 pages.

(Continued)

*Primary Examiner* — Fan S Tsang
*Assistant Examiner* — Angelica M McKinney
(74) *Attorney, Agent, or Firm* — Vista IP Law Group, LLP

(57) ABSTRACT

This disclosure provides a hearing aid comprising an assembly. The assembly comprises a microphone for reception of sound and conversion of the received sound into a corresponding first audio signal, and a signal processor for processing the first audio signal into a second audio signal compensating a hearing loss of a user of the hearing aid. The assembly comprises a wireless communication unit configured for wireless communication connected with an antenna for emission and/or reception of an electromagnetic field. The antenna comprises a first feed point connected to the wireless communication unit; and a second feed point. The antenna comprises a first branch connected to the first feed point.

18 Claims, 11 Drawing Sheets

(56) References Cited

U.S. PATENT DOCUMENTS

| | | | | |
|---|---|---|---|---|
| 2007/0080889 | A1* | 4/2007 | Zhang | H01Q 1/273 343/895 |
| 2008/0079645 | A1* | 4/2008 | Higasa | H01Q 1/2291 343/770 |
| 2010/0158291 | A1* | 6/2010 | Polinske | H04R 25/554 381/315 |
| 2010/0158295 | A1 | 6/2010 | Polinske et al. | |
| 2014/0185848 | A1* | 7/2014 | Ozden | H04R 25/554 381/315 |
| 2014/0226844 | A1 | 8/2014 | Kerselaers | |
| 2015/0042524 | A1* | 2/2015 | Kerselaers | H01Q 1/273 343/718 |

FOREIGN PATENT DOCUMENTS

| | | | |
|---|---|---|---|
| EP | 2 680 366 | A1 | 1/2014 |
| EP | 2 458 674 | A3 | 4/2014 |
| EP | 2 723 101 | A2 | 4/2014 |
| EP | 2 723 101 | A3 | 6/2014 |
| EP | 2 765 650 | A1 | 8/2014 |
| EP | 2 835 862 | A1 | 2/2015 |
| WO | WO 2014/090419 | A1 | 6/2014 |
| WO | WO 2014/090420 | A1 | 6/2014 |

OTHER PUBLICATIONS

First Technical Examination and Search Report dated Mar. 4, 2015, for corresponding Danish Patent Application No. PA 2014 70487, 6 pages.

First Office Action and Eng. Translation dated Feb. 9, 2018, for corresponding Japanese Patent Application No. JP 2015-156112, 4 pages.

* cited by examiner

HEARING AID WITH AN ANTENNA

RELATED APPLICATION DATA

This application claims priority to and the benefit of Danish Patent Application No. PA 2014 70487, filed Aug. 15, 2014, pending, and European Patent Application No. 14181151.3, filed Aug. 15, 2014, pending. The entire disclosures of both of the above patent applications are expressly incorporated by reference herein.

TECHNICAL FIELD

The present disclosure relates to a hearing aid having an antenna, the antenna being configured for providing the hearing aid with wireless communication capabilities.

BACKGROUND

Hearing aids are very small and delicate devices and comprise many electronic and metallic components contained in a housing small enough to fit in the ear canal of a human or behind the outer ear. The many electronic and metallic components in combination with the small size of the hearing aid housing impose high design constraints on radio frequency antennas to be used in hearing aids with wireless communication capabilities.

Moreover, the antenna in the hearing aid has to be designed to achieve a satisfactory performance despite the limitation and other high design constraints imposed by the size of the hearing aid.

SUMMARY

It is an object to provide a hearing aid with an improved wireless communication capability.

In one aspect, the above-mentioned and other objects are obtained by providing a hearing aid comprising an assembly. The assembly comprises a microphone for reception of sound and conversion of the received sound into a corresponding first audio signal, and a signal processor for processing the first audio signal into a second audio signal compensating a hearing loss of a user of the hearing aid. The assembly comprises a wireless communication unit configured for wireless communication connected with an antenna for emission and/or reception of an electromagnetic field. The antenna comprises a first feed point connected to the wireless communication unit; and a second feed point. The antenna comprises a first branch connected to the first feed point.

The first branch may comprise a first segment and a first free end. At least a part of the first segment may extend in a first plane. The antenna may furthermore comprise a second branch connected to the second feed point. The second branch may comprise a second segment and a second free end. At least a part of the second segment may extend in a second plane. The first feed point and the second feed point may be located between the first plane and the second plane.

The first feed point may not be located on the first plane and/or the second plane. The second feed point may not be located on the first plane and/or the second plane.

In one or more embodiments, at least a first part of the first branch is parallel to at least a first part of the second branch. For example, the part of the first segment extending in the first plane may be parallel to the part of the second segment extending in a second plane. Alternatively, the first segment may be parallel to at least a part of the second segment. The first plane may be parallel to the second plane.

In one or more embodiments, a current flowing in the first segment may have a direction that is opposite to a direction of current flowing in the second segment. A current in the first segment may flow in a direction parallel or substantially parallel to a surface of a head of a user, when the hearing aid is worn in its operational position on the head of the user. A current in the second segment may flow in a direction parallel or substantially parallel to a surface of a head of a user but opposite to the current flowing in the first segment, when the hearing aid is worn in its operational position on the head of the user. A current in the first segment and a current in the second segment may have substantially the same magnitude but run in opposite directions, thereby minimizing the radiation of the electromagnetic field in the direction parallel to the surface of the head of the user. It is envisaged that the current magnitudes may not be exactly the same, so that some radiation, though principally unwanted, from the first segment and the second segment may occur.

In one or more embodiments, the antenna of the hearing aid may have a partition plane. The partition plane may be any plane partitioning the antenna or any plane partitioning the hearing aid. The partition plane may be a plane of intersection, extending between the first branch and the second branch of the antenna. The partition plane may be a plane parallel to for example a face plate of an in-the-ear type hearing aid. The partition plane may be a plane parallel to a side of the hearing aid, such as parallel to a longitudinal side of the hearing aid. The partition plane may be a plane parallel to the surface of a head when the hearing aid is worn in its operational position on the head of a user. The partition plane may form a symmetry plane for the antenna, so that for example the first branch is symmetric with the second branch with respect to the partition plane. The partition plane may form a symmetry plane for the hearing aid.

In one or more embodiments, a second part of the first branch extending from the first plane to the first feed point is orthogonal to the partition plane. Additionally or alternatively, a second part of the second branch extending from the second plane to the second feed point may be orthogonal to the partition plane. The second part of the first branch extending from the first plane to the first feed point may be orthogonal or substantially orthogonal (normal +/−25 degrees) to a surface of a head of a user, when the hearing aid is worn in its operational position on the head of the user. The second part of the first branch extending from the first plane to the first feed point may be parallel or substantially parallel to an ear-to-ear axis, when the hearing aid is worn in its operational position on the head of the user. The second part of the first branch extending from the first plane to the first feed point may thus be parallel or substantially parallel to a through axis of the hearing aid, the through axis of the hearing aid being parallel to or substantially parallel to an ear-to-ear axis of a user, when the hearing aid is worn in its operational position on the head of the user. Thus, the second part of the first branch extending from the first plane to the first feed point may be orthogonal or substantially orthogonal (normal +/−25 degrees) to a face plate of the hearing aid.

The second part of the second branch extending from the second plane to the second feed point may be orthogonal or substantially orthogonal (normal +/−25 degrees) to a surface of a head of a user, when the hearing aid is worn in its operational position on the head of the user. The second part of the second branch extending from the second plane to the second feed point may be orthogonal or substantially orthogonal (normal +/−25 degrees) to a face plate of the hearing aid. The second part of the second branch extending from the second plane to the second feed point may be parallel or substantially parallel to an ear-to-ear axis, when the hearing aid is worn in its operational position on the head of the user. The second part of the second branch extending from the second plane to the second feed point may thus be parallel or substantially parallel to a through axis of the hearing aid, the through axis of the hearing aid being parallel to or substantially parallel to an ear-to-ear axis of a user, when the hearing aid is worn in its operational position on the head of the user A current flowing in the second part of the first branch has a same direction as a current flowing in the second part of the second branch. The currents in the second part of the first branch and in the second part of the second branch flow in a direction that is orthogonal (normal +/−25 degrees) to a surface of a head of a user, when the hearing aid is worn in its operational position on the head of the user. The currents in the second part of the first branch and in the second part of the second branch may flow in a direction that is orthogonal (normal +/−25 degrees) to a face plate of a hearing aid. The currents in the second part of the first branch and in the second part of the second branch may flow in a direction that is parallel or substantially parallel to an ear-to-ear axis, when the hearing aid is worn in its operational position on the head of the user. The currents flowing in the second part of the first branch and in the second part of the second branch may contribute to an electromagnetic field that travels around the head of the user thereby providing a wireless communication that is robust and has low loss.

In one or more embodiments, the hearing aid comprises a dipole antenna.

The antenna of the hearing aid may have a third plane comprising the first feed point and the second feed point. The first segment and/or the second segment may not intersect the third plane. The first segment and/or the second segment may not cross over the third plane formed by the feed points. The third plane may not comprise the first free end and/or the second free end, thus, the first free end and/or the second free end may be positioned outside of the third plane.

The first feed point may be connected to the wireless communication unit through a first transmission line. The second feed point may be connected to the wireless communication unit through a second transmission line. The first transmission line and the second transmission line may be non-radiating transmission lines. The first transmission line and the second transmission line may be balanced tansmission lines. A current from the wireless communication unit to the first feed point for the first branch and a current to the second feed point for the second branch may thus have substantially the same magnitude but run in opposite directions, thereby establishing a balanced feed line. It is envisaged that the current magnitudes may not be exactly the same, so that some radiation, though principally unwanted, from the feed line may occur.

The second feed point may be connected to a ground plane, such as connected to a ground plane via a transmission line.

The first free end may be located across from the second free end with respect to a partition plane. The first free end and the second free end may be provided at equal distances from the partition plane. The first free end and the second free end may be provided symmetrically with respect to the partition plane. The partition plane may be a partition plane of the antenna, such as a symmetry plane of the antenna. The partition plane may be a partition plane of the hearing aid, such as a partition plane extending along the longitudinal axis of the hearing aid, such as a partition extending along the in-the-ear axis of the hearing aid.

In one or more embodiments, the hearing aid may be an in-the-ear type hearing aid and may comprise a face plate. At least a part of the first branch and/or at least a part of the second branch may be positioned adjacent the face plate. For example, the first segment may be adjacent to the face plate. Alternatively, the second segment may be adjacent to the face plate. The face plate may comprise a part of the antenna, and/or a part of the first branch and/or a part of the second branch.

A part of the face plate may extend in a front plane, and the first plane and/or the second plane may be parallel with the front plane. The front plane may be orthogonal (or normal +/−25 degrees) to an ear-to-ear axis, orthogonal (or normal +/−25 degrees to a through axis of the in-the-ear type hearing aid. The front plane may be parallel or substantially parallel to a surface of a head of a user, when the hearing aid is worn in its operational position on the head of the user. The first plane and/or the second plane may be parallel to at least a part of the face plate, or to a surface of a head of a user, when the hearing aid is worn in its operational position on the head of the user. The first segment and/or the second segment may be parallel to the front plane, or to a part of the face plate, or to a surface of a head of a user, when the hearing aid is worn in its operational position on the head of the user. The second part of the first branch may be orthogonal (or normal +/−25 degrees) to the front plane. Additionally or alternatively, the second part of the second branch may be orthogonal (or normal +/−25 degrees) to the front plane. The second part of the first branch and/or the second part of the second branch may be orthogonal to a part of the face plate, or to a surface of a head of a user, when the hearing aid is worn in its operational position on the head of the user.

In one or more embodiments, the first branch comprises one or more bends, and/or the second branch comprises one or more bends. In general, various branches of the antenna may be formed having different geometries, the branches may be wires or patches, bend or straight, long or short as long as they obey the above relative configuration with respect to each other such that the first feed point and the second feed point are located between the first plane and the second plane. The first branch having one or more bends may result in the first branch having a first segment, an additional segment not parallel to the first segment, and an additional segment parallel to the first segment, so as to fit inside the hearing aid.

In one or more embodiments, a shortest distance between the first segment and the second segment is between 1.5 mm and 6.5 mm. A shortest distance between a point in the first segment and a point in the second segment may be between 1.5 mm and 6.5 mm. A shortest distance between the first plane and the second plane may be between 1.5 mm and 6.5 mm. A shortest distance between the first free end and the second free end may be between 1.5 mm and 6.5 mm. The shortest distance between the first segment and the second segment may be less than 6.5 mm, such as less than 5 mm, such as less than 4 mm, such as less than 3 mm. The shortest distance between the first segment and the second segment may be at least 1.5 mm, such as at least 2 mm, such as at least 3 mm. The shortest distance between the first segment and the second segment may be between 1 mm and 7 mm, such as between 2 mm and 6 mm, such as between 3 mm and 6 mm, between 1 mm and 3 mm.

The hearing aid may be an in-the-ear type hearing aid. The in-the-ear type hearing aid typically has an elongated housing shaped to fit in-the-ear canal. A partition axis or a through axis in this type of hearing aid is parallel to the ear axis, whereas the face plate of the in-the-ear type hearing aid typically is in a plane orthogonal to the ear axis. In other words, a partition axis in this type of hearing aid is in a plane orthogonal to a surface of a head of a user, whereas the face plate of the in-the-ear type hearing aid typically is parallel to a surface of a head of a user and thus orthogonal to the face place or to the plane in which the face plate extends.

The hearing aid may be a behind-the-ear type hearing aid. The behind-the-ear type of hearing aid typically also has an elongated housing most often shaped as a banana to rest on top of the auricle of the ear. The assembly of this type of hearing aid will thus have a longitudinal axis parallel to the surface of the head of the user and orthogonal to the ear axis. Thus, the ear axis for a behind the ear hearing aid may be orthogonal to the longitudinal axis of the behind the ear hearing aid. A through axis of the behind-the-ear hearing aid will be parallel to the ear axis and orthogonal to the longitudinal axis of the hearing aid.

In a behind-the-ear type of hearing aid, the first plane and/or the second plane may be parallel or substantially parallel to a longitudinal side of the hearing aid, and thus orthogonal to or substantially orthogonal to a through axis of the hearing aid. A part of the first segment and/or a part of the second segment may be parallel +/−25% to a part of longitudinal side of the hearing aid. A part of the first segment and/or a part of the second segment may be parallel to a longitudinal side of the hearing aid. The first segment and/or the second segment may be partially parallel to a part of longitudinal side of the hearing aid.

In some embodiments, a length of the first branch may be at least a quarter of a wavelength of an electromagnetic field emitted by the antenna of the hearing aid, such as $\lambda/4+/-10\%$. A length of the second branch may be at least a quarter of a wavelength of an electromagnetic field emitted by the antenna of the hearing aid, such as $\lambda/4+/-10\%$. The length of the first branch may correspond to the length of the second branch, so that the first branch and second branch have a same length. In some embodiments, the length of the first branch may be different from the length of the second branch.

The hearing aid disclosed herein may be configured for operation in ISM frequency band. Preferably, the antenna is configured for operation at a frequency of at least 1 GHz, such as at a frequency between 1.5 GHz and 3 GHz such as at a frequency of 2.4 GHz.

It is an advantage that, during operation, the second part of the first branch and the second part of the second branch may contribute to an electromagnetic field that travels around the head of the user, such as more efficiently around the head of a user, and may thereby provide a wireless data communication that is robust and has low loss.

Due to the current component normal to the side of the head or normal to any other body part, the surface wave of the electromagnetic field may be more efficiently excited. Hereby, for example an ear-to-ear path gain may be improved, such as by 10-15 dB, such as by 10-30 dB.

In the following the embodiments are described primarily with reference to a hearing aid, such as a binaural hearing aid. It is however envisaged that the disclosed features and embodiments may be used in combination with any aspect described herein.

A hearing aid includes an assembly, the assembly comprising: a microphone for reception of sound and conversion of the received sound into a corresponding first audio signal; a signal processor for processing the first audio signal into a second audio signal compensating a hearing loss of a user of the hearing aid; a wireless communication unit configured for wireless communication; an antenna configured for electromagnetic field emission and/or electromagnetic field reception, the antenna comprising: a first feed point connected to the wireless communication unit, a second feed point, a first branch connected to the first feed point, the first branch comprising a first segment and a first free end, wherein at least a part of the first segment extends in a first plane, and a second branch connected to the second feed point, the second branch comprising a second segment and a second free end, wherein at least a part of the second segment extends in a second plane, wherein the first feed point and the second feed point are located between the first plane and the second plane.

Optionally, at least a first part of the first branch is parallel to at least a first part of the second branch, and/or wherein the at least part of the first segment is parallel to the at least part of the second segment.

Optionally, a current flowing in the first segment has a direction that is opposite to a direction of current flowing in the second segment.

Optionally, the antenna has a partition plane, wherein a part of the first branch extending from the first plane to the first feed point is orthogonal to the partition plane; and/or wherein a part of the second branch extending from the second plane to the second feed point is orthogonal to the partition plane.

Optionally, the first free end is located across from the second free end with respect to the partition plane.

Optionally, the antenna has a third plane comprising the first feed point and the second feed point, wherein the first segment and/or the second segment does not intersect the third plane.

Optionally, the third plane does not comprise the first free end and/or the second free end.

Optionally, the second feed point is connected to a ground plane.

Optionally, the hearing aid further includes a face plate, wherein at least a part of the first branch and/or at least a part of the second branch is positioned adjacent the face plate.

Optionally, a part of the face plate extends in a front plane, and wherein the first plane and/or the second plane is parallel with the front plane.

Optionally, a part of the first branch is orthogonal to the front plane, and/or a part of the second branch is orthogonal to the front plane.

Optionally, the first branch comprises one or more bends, and/or the second branch comprises one or more bends.

Optionally, a shortest distance between the first segment and the second segment is between 1.5 mm and 6.5 mm.

Optionally, the hearing aid is an in the ear type hearing aid.

Optionally, the hearing aid is a behind-the-ear hearing aid.

Optionally, the first plane and/or the second plane is substantially parallel to a longitudinal side of the hearing aid.

The above and other features and advantages will become more apparent to those of ordinary skill in the art by describing in detail exemplary embodiments thereof with reference to the attached drawings in which:

DETAILED DESCRIPTION OF THE DRAWINGS

Figure 1:
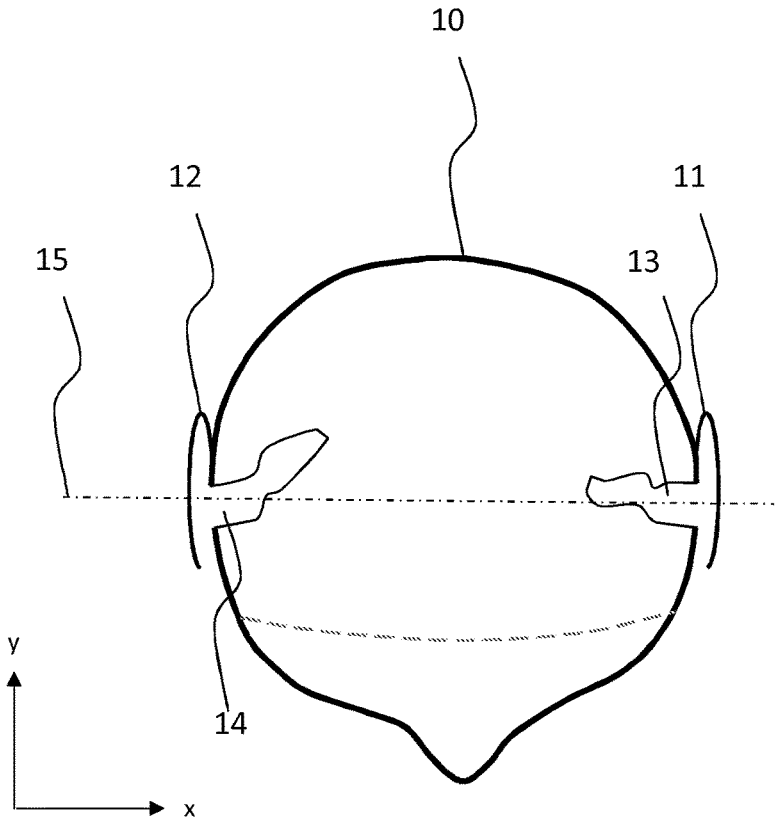
FIG. 1 is a head model of a user together with an ordinary two dimensional coordinate system with an x, y axis for defining the geometrical anatomy of the head of the user.

Various embodiments are described hereinafter with reference to the figures. It should be noted that elements of similar structures or functions are represented by like reference numerals throughout the figures. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

The embodiments will now be described more fully hereinafter with reference to the accompanying drawings, in which exemplary embodiments are shown. The claimed invention may, however, be embodied in different forms and should not be construed as limited to the embodiments set forth herein.

FIG. 1 is a head model of a user seen from above together with the ordinary two dimensional coordinate system. When designing antennas for wireless communication proximate the human body, the human head can be approximated by a rounded enclosure with sensory organs, such as the nose, ears, mouth and eyes attached thereto. Such a rounded enclosure 10 is illustrated in FIG. 1. In FIG. 1, the head model 10 is shown from above together with an ordinary two dimensional coordinate system with an x, and y axis for defining orientations with relation to the head and for defining the geometrical anatomy of the head of the user. The user modelled with the head of FIG. 1 is standing erect on the ground (not shown in the figure), and the ground plane is parallel to the xy-plane. The head model 10 comprises a left ear 11 and a right ear 12. The left ear 11 has a left ear canal 13. The right ear 12 has a right ear canal 14. An in-the-ear hearing aid is to be placed with at least a part going into the ear canal 13, 14. The axis 15 going from an opening of the right ear canal 14 to an opening of the left ear canal 13 is parallel to the x-axis of FIG. 1. The axis 15 is an ear-to-ear axis or an ear axis. The axis 15 is thus orthogonal to the surface of the head at the points where it leaves the surface of the head. The ear-to-ear axis as well as the surface of the head will in the following be used as reference when describing specific configurations of the elements of the present disclosure.

Every point of the surface of the head has a normal and tangential vector. The normal vector is orthogonal to the surface of the head while the tangential vector is parallel to the surface of the head. An element extending along the surface of the head is said to be parallel to the surface of the head, likewise a plane extending along the surface of the head is said to be parallel to the surface of the head, while an object or a plane extending from a point on the surface of the head and radially outward from the head into the surrounding space is said to be orthogonal to the surface of the head.

Since the auricle of the ear is primarily located in the plane parallel to the surface of the head on most test persons, it is often described that the ear-to-ear axis also functions as the normal to the ear. Even though there will be variations from person to person as to how the plane of the auricle is oriented, it is envisaged that the plane of the auricle is parallel to the surface of the head.

The hearing aid may be an in-the-ear type hearing aid. The hearing aid may be a behind the ear type of hearing aid. The in-the-ear type hearing aid has an elongated housing shaped to fit in-the-ear canal. A partition axis in this type of hearing aid is parallel to the ear axis 15, whereas the face plate of the in-the-ear type hearing aid typically is in a plane orthogonal to the ear axis 15. In other words, a partition axis in this type of hearing aid is in a plane orthogonal to a surface of a head of a user, whereas the face plate of the in-the-ear type hearing aid typically is parallel to a surface of a head of a user. The behind the ear type of hearing aid typically also has an elongated housing most often shaped as a banana to rest on top of the auricle of the ear. The assembly of this type of hearing aid will thus have a longitudinal axis (such as axis 59 of FIG. 5) parallel to the surface of the head of the user.

Figure 2:
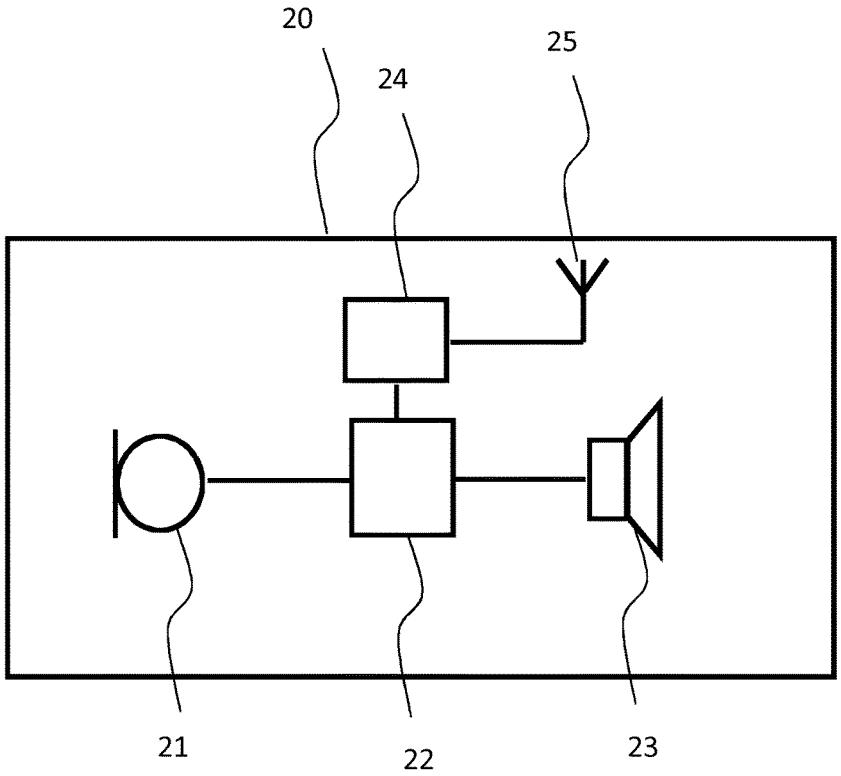
FIG. 2 shows a block-diagram of a typical hearing aid.

FIG. 2 shows a block-diagram of a typical hearing aid. In FIG. 2, the hearing aid 20 comprises a microphone 21 for receiving incoming sound and converting it into an audio signal, i.e. a first audio signal. The first audio signal is provided to a signal processor 22 for processing the first audio signal into a second audio signal compensating a hearing loss of a user of the hearing aid. A receiver may be connected to an output of the signal processor 22 for converting the second audio signal into an output sound signal, e.g. a signal modified to compensate for a user's hearing impairment, and provides the output sound to a speaker 23. Thus, the hearing instrument signal processor 22 may comprise elements such as amplifiers, compressors and noise reduction systems etc. The hearing aid may further have a feedback loop for optimizing the output signal. The hearing aid comprises a wireless communication unit 24 (e.g. a transceiver) for wireless communication connected with an antenna 25 for emission and reception of an electromagnetic field. The wireless communication unit 24 may connect to the hearing aid signal processor 22 and to the antenna 25, for communicating with e.g. external devices, or with another hearing aid, located at another ear, in a binaural hearing aid system. In a behind-the-ear hearing aid, the components 21, 22, 23, 24, 25 are placed in a housing of the hearing aid. In a receiver-in-the-ear hearing aid, the receiver is placed in the ear. In a microphone-in-the-ear hearing aid, the microphone 21 is place in the ear.

The wireless communications unit may be configured for wireless data communication, and in this respect connected with the antenna for emission and/or reception of an electromagnetic field. The wireless communications unit may comprise a transmitter, a receiver, a transmitter-receiver pair, such as a transceiver, a radio unit, etc. The wireless communications unit may be configured for communication using any protocol as known for a person skilled in the art, including Bluetooth, WLAN standards, manufacture specific protocols, such as tailored proximity antenna protocols, such as proprietary protocols, such as low-power wireless communication protocols, etc.

The specific wavelength, and thus the frequency of the emitted electromagnetic field, is of importance when considering communication involving an obstacle. In the present disclosure, the obstacle is a head. The hearing aid comprising an antenna may be located closed to the surface of the head or in the ear canal. If the wavelength is too long such as a frequency of 1 GHz and down to lower frequencies greater parts of the head will be located in the near field region. This results in a different diffraction making it more difficult for the electromagnetic field to travel around the head. If on the other hand the wavelength is too short, the head will appear as being too large an obstacle which also makes it difficult for electromagnetic waves to travel around the head. An optimum between long and short wavelengths is therefore preferred. In general the ear to ear communication is to be done in the band for industry, science and medical with a desired frequency centred around 2.4 GHz.

Figure 3:
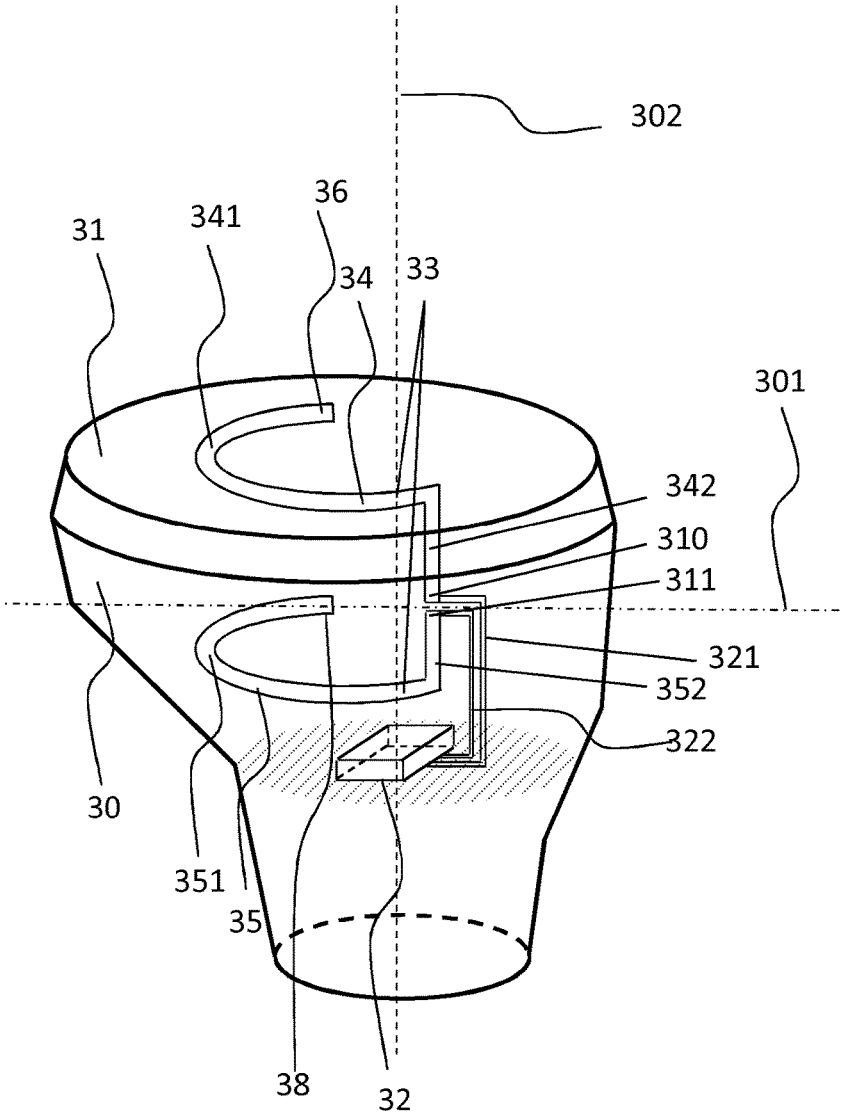
FIG. 3 shows an in-the-ear hearing aid having an antenna according to one embodiment of the present disclosure.

FIG. 3 shows an exemplary in-the-ear hearing aid 30 having an antenna 33 according to one embodiment of the present disclosure. The hearing aid 30 comprises an assembly. The assembly comprises a wireless communication unit 32 for wireless communication interconnected with an antenna 33 for emission and/or reception of an electromagnetic field. The wireless communication unit 32 may connect to a hearing aid signal processor. The wireless communication unit 32 is connected to the antenna 33, for communicating with e.g. external devices, or with another hearing aid, located at another ear, in a binaural hearing aid system. The antenna 33 of the hearing aid 30 comprises a first feed point 310 connected to the wireless communication unit 32 and a second feed point 311. The antenna 33 of the hearing aid 30 comprises a first branch 34 connected to the first feed point 310 and a second branch 35 connected to the second feed point 311. The first branch 34 comprises a first segment 341 and a first free end 36. At least a part of the first segment 341 extends in a first plane. The second branch 35 comprises a second segment 351 and a second free end 38. At least a part of the second segment 351 extends in a second plane. The first feed point 310 and the second feed point 311 are located between the first plane and the second plane. The first feed point 310 is not located on the first plane and/or the second plane. The second feed point 311 is not located on the first plane and/or the second plane. At least a first part of the first branch 34 is parallel to at least a first part of the second branch 35. For example, the at least part of the first segment 341 is parallel to the at least part of the second segment 351. Alternatively, the first segment 341 is parallel to at least a part of the second segment 351. The first plane may be parallel to the second plane. The antenna 33 has a partition plane 301, such as a plane of intersection, extending between the first branch 34 and the second branch 35 of the antenna 33. The partition plane 301 may be a symmetry plane of the antenna 33. The antenna 33 comprises a second part 342 of the first branch 34 extending from the first plane to the first feed point 310 and/or a second part 352 of the second branch 35 extending from the second plane to the second feed point 311. The second part 342 of the first branch 34 extending from the first plane to the first feed point 310 is orthogonal to the partition plane 301. Additionally or alternatively, the second part 352 of the second branch 35 extending from the second plane to the second feed point 311 is orthogonal to the partition plane 301. A second part of the first branch 34 extending from the first plane to the first feed point 310 may be orthogonal or substantially orthogonal (normal +/−25 degrees) to a surface of a head of a user, when the hearing aid is worn in its operational position on the head of the user. A second part of the first branch 34 extending from the first plane to the first feed point 310 may be orthogonal or substantially orthogonal (normal +/−25 degrees) to a face plate 31 of the hearing aid 30. A second part of the first branch 34 extending from the first plane to the first feed point 310 may be parallel or substantially parallel to an ear-to-ear axis 15 or an in-the-ear axis 302, when the hearing aid is worn in its operational position on the head of the user. The second part 352 of the second branch 35 extending from the second plane to the second feed point 311 may be orthogonal or substantially orthogonal (normal +/−25 degrees) to a surface of a head of a user, when the hearing aid is worn in its operational position on the head of the user. The second part 352 of the second branch 35 extending from the second plane to the second feed point 311 may be orthogonal or substantially orthogonal (normal +/−25 degrees) to a face plate 31. The second part 352 of the second branch 35 extending from the second plane to the second feed point 311 may be parallel or substantially parallel to an ear-to-ear axis (e.g. axis 15 of FIG. 1) or an in-the-ear axis 302, when the hearing aid is worn in its operational position on the head of the user.

The first branch 34 comprises a second part 342 extending from the first plane to the first feed point 310. For example, the first branch 34 comprises a second part 342 extending from an end of the first segment 341 to the first feed point 310. The second branch 35 comprises a second part 352 extending from the second plane to the first feed point 310. For example, the second branch 35 comprises a second part 352 extending from an end of the second segment 351 to the second feed point 311. The antenna 33 has a third plane comprising the first feed point 310 and the second feed point 311. The first segment 341 and/or the second segment 351 may not intersect the third plane. The third plane may not comprise the first free end 36 and/or the second free end 38. The first feed point 310 is connected to the wireless communication unit 32 through a first transmission line 321. The second feed point 311 is connected to the wireless communication unit 32 through a second transmission line 322. The first transmission line 321 and the second transmission line 322 may be non-radiating transmission lines. The first transmission line 321 and the second transmission line 322 may be balanced. The current from the wireless communication unit 32 to the first feed point 310 and the current to the second feed point 311 may thus have substantially the same magnitude but run in opposite directions, thereby establishing a balanced feed line. It is envisaged that the current magnitudes may not be exactly the same, so that some radiation, though principally unwanted, from the feed line may occur.

The first free end 36 is located across from the second free end 38 with respect to the partition plane 301. The first free end 36 is provided symmetrically to the second free end 38 with respect to the partition plane 301

The hearing aid 30 comprises a face plate 31. The hearing aid 30 is to be inserted in the ear of a user with the deep end in the ear canal. The side facing out of the ear and which is often directly visible is called the front plate or the face plate. Of all the sides of the hearing aid, the face plate side is the one that is least concealed by the ear. The faceplate has an opening such that sound can reach a microphone in the device. At least a part of the first branch 34 and/or at least a part of the second branch 35 is positioned adjacent the face plate 31. For example, the first segment 341 is adjacent to the face plate 31. Alternatively, the second segment 351 may be adjacent to the face plate 31. The face plate 31 may comprise a part of the antenna 33, and/or a part of the first branch 34 and/or a part of the second branch 35. For example, the face plate 31 may comprise a part of the first segment 351.

A part of the face plate extends in a front plane, and the first plane and/or the second plane may be parallel with the front plane. The front plane may be orthogonal (or normal +/−25 degrees) to an ear-to-ear axis. The front plane may be parallel or substantially parallel to a surface of a head of a user, when the hearing aid is worn in its operational position on the head of the user. The first plane and/or the second plane may be parallel to a part of the face plate 31, or to a surface of a head of a user, when the hearing aid is worn in its operational position on the head of the user. A part of the first segment 341 and/or a part of the second segment 351 may be parallel with the front plane to a part of the face plate 31, or to a surface of a head of a user, when the hearing aid is worn in its operational position on the head of the user. The first segment 341 and/or the second segment 351 may be parallel to the front plane, or to a part of the face plate 31, or to a surface of a head of a user, when the hearing aid is worn in its operational position on the head of the user. The second part 342 of the first branch 34 is orthogonal (or normal +/−25 degrees) to the front plane. Additionally or alternatively, the second part 352 of the second branch 35 is orthogonal (or normal +/−25 degrees) to the front plane. The second part 342 of the first branch 34 and/or the second part 352 of the second branch 35 may be orthogonal to a part of the face plate 31, or to a surface of a head of a user, when the hearing aid is worn in its operational position on the head of the user.

In one or more embodiments, a shortest distance between the first segment 341 and the second segment 351 is between 1.5 mm and 6.5 mm. A shortest distance between the first free end 36 and the second free end 38 may be between 1.5 mm and 6.5 mm. A shortest distance between a point in the first segment 341 and a point in the second segment 351 may be between 1.5 mm and 6.5 mm. A shortest distance between the first plane and the second plane may be between 1.5 mm and 6.5 mm. The shortest distance between the first segment 341 and the second segment 351 may be less than 6.5 mm, such as less than 5 mm, such as less than 4 mm, such as less than 3 mm. The shortest distance between the first segment 341 and the second segment 351 may be at least 1.5 mm, such as at least 2 mm, such as at least 3 mm. The shortest distance between the first segment 341 and the second segment 351 may be between 1 mm and 7 mm, such as between 2 mm and 6 mm.

In one or more embodiments, the second feed point may be connected to a ground plane.

Figure 4A:
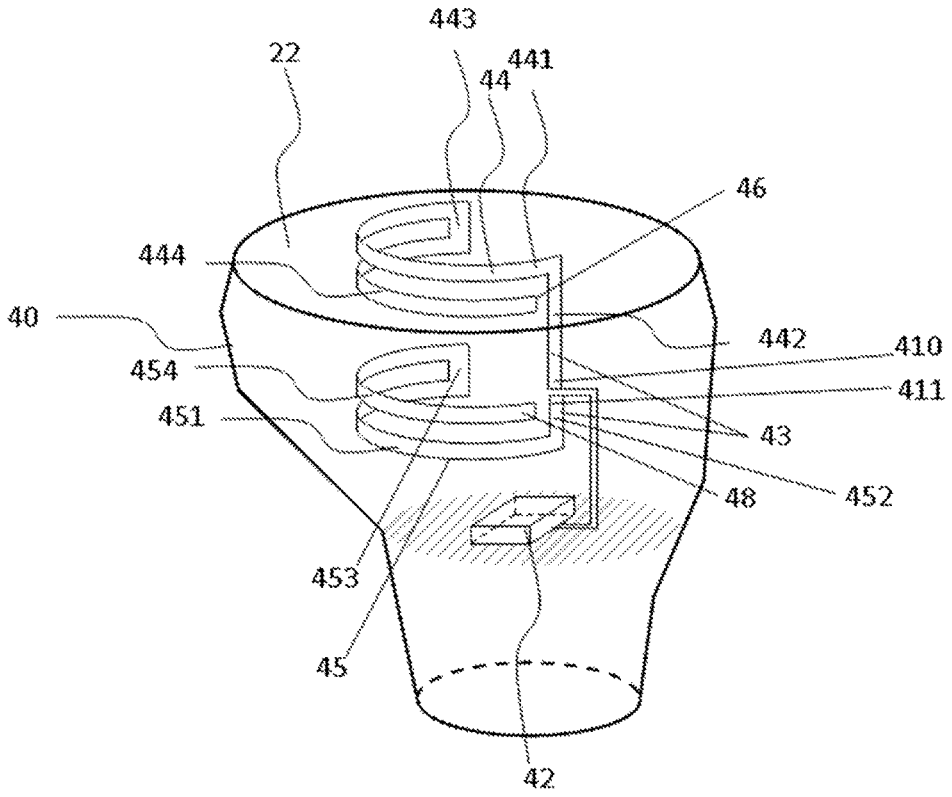
FIG. 4*a* shows an exemplary in-the-ear hearing aid having an antenna.

FIG. 4*a* shows an exemplary in-the-ear hearing aid 40 having an antenna 43 according to another embodiment of the present disclosure. The hearing aid 40 comprises an assembly. The assembly comprises a wireless communication unit 42 (e.g. a transceiver) for wireless communication connected with an antenna 43 for emission and/or reception of an electromagnetic field. The wireless communication unit 42 may connect to the antenna 43, for communicating with e.g. external devices, or with another hearing aid, located at another ear, in a binaural hearing aid system. The antenna 43 of the hearing aid 40 comprises a first feed point 410 connected to the wireless communication unit 42 and a second feed point 411. The antenna 43 of the hearing aid 40 comprises a first branch 44 connected to the first feed point 410 and a second branch 45 connected to the second feed point 411. The first branch 44 comprises a first segment 441 and a first free end 46. The first branch 44 comprises a second part 442 extending from the first feed point 410 to the first segment 441. The first branch 44 comprises one or more bends. The first segment 441 and the second part 442 form a bend. The first branch 44 comprises an additional segment 443 and a segment 444 that together form a bend. The first branch 44 has a first segment 441 with a first turn extending in a first angular direction and a second turn extending in a second angular direction. The first angular direction is different from the second angular direction, e.g.an opposite direction, such that the current in the first turn will flow in an opposite direction to the direction of the current that will flow in the second turn. The first turn is in a first plane and the second turn is in a second plane such that the first turn is closer to the outer surface of the faceplate than the second turn. Thereby the distance between the first end 46 and the second end 48 is shorter than the depth of the antenna.

The second branch 45 comprises a second segment 451 and a second free end 48. The second branch 45 comprises one or more bends. The second branch 45 comprises a second part 452 extending from the first feed point 411 to the first segment 451 The second branch 45 comprises an additional segment 453, and a segment 454 that together form a bend. A shortest distance between the first segment 441 and a segment of the second branch closest to the first branch, i.e. segment 454 in FIG. 4, may be between 1.5 mm and 6.5 mm. For example, the distance between the first free end 46 and the second free end 48 is between 1.5 mm and 6.5 mm.

The hearing aid 40 may be smaller than the hearing aid 30 of FIG. 3. The geometry of the first branch 44 can be derived by applying the absolute value function to a helix, i.e. $(x,y,z)=(\cos(t),|\sin(t)|,t)$. Thus, the helix only has positive y-values in the xy-plane and the helix is open along its axis.

Figure 4B:
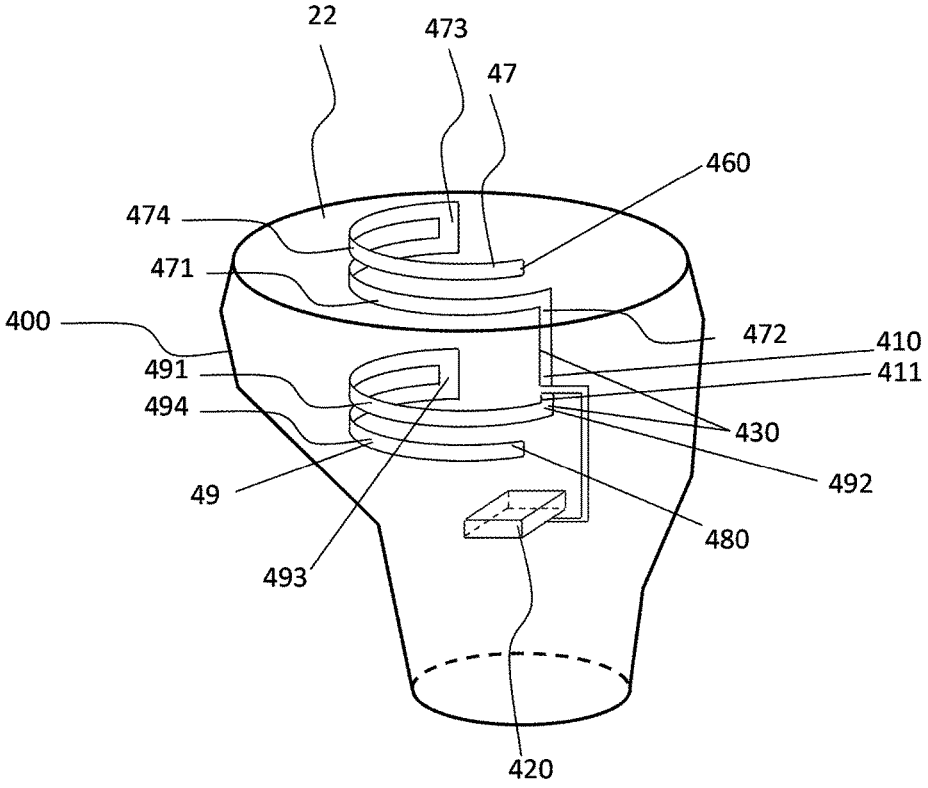
FIG. 4*b* shows another exemplary in-the-ear hearing aid having an antenna.

FIG. 4*b* shows an exemplary in-the-ear hearing aid 400 having an antenna 430 according to another embodiment of the present disclosure. The hearing aid 400 comprises an assembly. The assembly comprises a wireless communication unit 420 (e.g. a transceiver) for wireless communication connected with an antenna 430 for emission and/or reception of an electromagnetic field. The wireless communication unit 420 may connect to the antenna 430, for communicating with e.g. external devices, or with another hearing aid, located at another ear, in a binaural hearing aid system. The antenna 430 of the hearing aid 400 comprises a first feed point 410 connected to the wireless communication unit 420 and a second feed point 411. The antenna 430 of the hearing aid 400 comprises a first branch 47 connected to the first feed point 410 and a second branch 49 connected to the second feed point 411. The first branch 47 comprises a first segment 471 and a first free end 460. The first branch 47 comprises a second part 472 extending from the first feed point 410 to the first segment 471. The first branch 47 comprises one or more bends. The first segment 471 and the second part 472 form a bend. The first branch 47 comprises an additional segment 473 and a segment 474 that together form a bend. The first branch 47 has a first segment 471 with a first turn extending in a first angular direction and a second turn extending in a second angular direction. The first angular direction is different from the second angular direction, e.g.an opposite direction, such that the current in the first turn will flow in an opposite direction to the direction of the current that will flow in the second turn. The first turn is in a first plane and the second turn is in a second plane such that the second turn is closer to the outer surface of the faceplate 22 than the first turn. Thereby, the first end 460 is further away from the second end 480 than in FIG. 4*a* such that the distance between the first end 460 and the second end 480 corresponds to the depth of the antenna.

The second branch 49 comprises a second segment 491 and a second free end 48. The second branch 49 comprises one or more bends. The second branch 49 comprises an additional segment 493, and a segment 494 that together form a bend. A shortest distance between the first segment 471 and a segment of the second branch closest to the first branch, i.e. segment 491 in FIG. 4*b*, may be between 1.5 mm and 6.5 mm.

Figure 5:
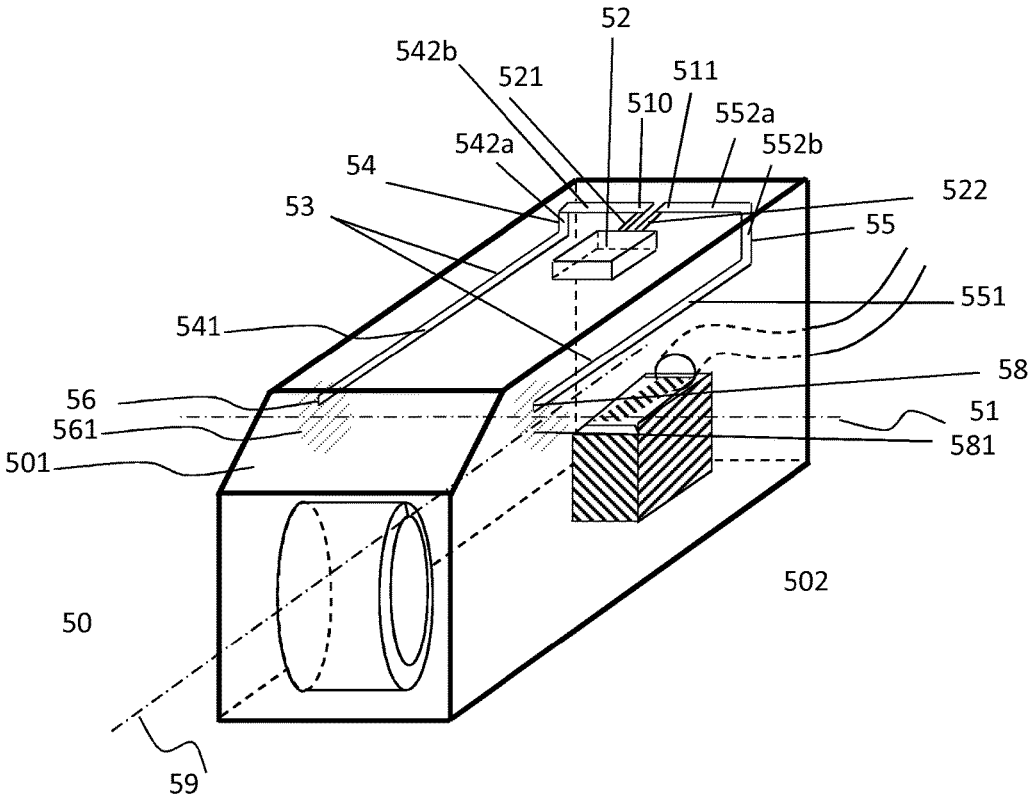
FIG. 5 shows a behind the ear hearing aid having an antenna according to a further embodiment of the present disclosure.

FIG. 5 shows a behind the ear hearing aid 50 having an antenna 53 according to a further embodiment of the present disclosure. The behind the ear hearing aid 50 comprises an assembly. The assembly comprises a wireless communication unit 52 for wireless communication connected with an antenna 53 for emission and/or reception of an electromagnetic field. The wireless communication unit 52 is connected to the antenna 53, for communicating with e.g. external devices, or with another hearing aid, located at another ear, in a binaural hearing aid system. The antenna 53 of the hearing aid 50 comprises a first feed point 510 connected to the wireless communication unit 52 and a second feed point 511. The antenna 53 of the hearing aid 50 comprises a first branch 54 connected to the first feed point 510 and a second branch 55 connected to the second feed point 511. The first branch 54 comprises a first segment 541 and a first free end 56. At least a part of the first segment 541 extends in a first plane. The second branch 55 comprises a second segment 551 and a second free end 58. At least a part of the second segment 551 extends in a second plane. The first feed point 510 and the second feed point 511 are located between the first plane and the second plane. The first plane and/or the second plane is parallel to a longitudinal side 501 or 502 of the hearing aid 50. At least a part of the first segment 541 extends along the first side 501 of the hearing aid 50, such as along a first longitudinal side of the hearing aid. At least a part of the second segment 551 extends along the second side 502 of the hearing aid 50, such as along a second longitudinal side of the hearing aid. The first segment 541 is adjacent to the first side 501. The second segment 541 is adjacent to the second side 502. The antenna 53 comprises at least a first part of the first branch 54 that is parallel to at least a first part of the second branch 55. For example, the at least part of the first segment 541 is parallel to the at least part of the second segment 551. Alternatively, the first segment 541 is parallel to at least a part of the second segment 551. The antenna 53 has a partition plane, such as a plane of intersection, extending between the first branch 54 and the second branch 55 of the antenna 53. The partition plane may be a symmetry plane of the antenna 53 or a symmetry plane of the hearing aid assembly, or a symmetry plane of the hearing aid 50. The antenna 53 comprises a second part 542*a*, 542*b* of the first branch 54 extending from the first plane to the first feed point 510 and a second part 552*a*, 552*b* of the second branch 55 extending from the second plane to the second feed point 511. The second part 542*a*, 542*b* of the first branch 54 extending from the first plane to the first feed point 510 is orthogonal to the partition plane. Additionally or alternatively, the second part 552*a*, 552*b* of the second branch 55 extending from the second plane to the second feed point 511 is orthogonal to the partition plane.

The first free end 56 is in a first end plane 561 parallel to a first side 501 of the hearing aid 50. The second free end 58 is in a second end plane 581 parallel to the first side 501 and/or the second side 502. The first end plane 561 has a first circular area with a first radius. The second end plane 581 has a second circular area with a second radius. A first axis 51 extends through the center of the first circular area forming plane 561 and the second circular area forming plane 581. The first free end 56 is located within the first radius. The second free end 58 is located within the second radius. The first radius and the second radius are less than 4 mm.

The first branch 54 comprises a second part 542*a*, 542*b* extending from the first plane to the first feed point 510. For example, the first branch 54 comprises a second part 542*a*, 542*b* extending from an end of the first segment 541 to the first feed point 510. The second branch 55 comprises a second part 552*a*, 552*b* extending from the second plane to the first feed point 510. For example, the second branch 55 comprises a second part 552*a*, 552*b* extending from an end of the second segment 551 to the second feed point 511. A second part of the first branch 54 extending from the first plane to the first feed point 510 may be orthogonal or substantially orthogonal (normal +/−25 degrees) to a surface of a head of a user, when the hearing aid is worn in its operational position on the head of the user. A second part of the first branch 54 extending from the first plane to the first feed point 510 may be parallel or substantially parallel to an ear-to-ear axis, when the hearing aid is worn in its operational position on the head of the user. The second part 542 of the first branch 54 extending from the second plane to the first feed point 510 may be orthogonal or substantially orthogonal (normal +/−25 degrees) to a longitudinal side 501,502 of the hearing aid. A second part 552 of the second branch 55 extending from the second plane to the second feed point 511 may be orthogonal or substantially orthogonal (normal +/−25 degrees) to a surface of a head of a user, when the hearing aid is worn in its operational position on the head of the user. The second part 552 of the second branch 55 extending from the second plane to the second feed point 511 may be orthogonal or substantially orthogonal (normal +/−25 degrees) to a longitudinal side 501,502 of the hearing aid. The second part 552 of the second branch 55 extending from the second plane to the second feed point 511 may be parallel or substantially parallel to an ear-to-ear axis (e.g. axis 15 of FIG. 1 or x axis of FIG. 1), when the hearing aid is worn in its operational position on the head of the user.

The first feed point 510 is connected to the wireless communication unit 52 through a first transmission line 521. The second feed point 511 is connected to the wireless communication unit 52 through a second transmission line 522. The first transmission line 521 and the second transmission line 522 may be non-radiating transmission lines. The first transmission line 521 and the second transmission line 522 may be balanced. The current from the wireless communication unit 52 to the first feed point 510 for the first branch 54 extending proximate the first side of the hearing aid and the current to the second feed point 511 for the second branch 55 extending proximate the second side of the hearing aid may thus have substantially the same magnitude but run in opposite directions, thereby establishing a balanced feed line. It is envisaged that the current magnitudes may not be exactly the same, so that some radiation, though principally unwanted, from the feed line may occur.

The first free end 56 is located across from the second free end 58 with respect to a partition plane, such as partition plane of the antenna, or a partition plane of the hearing aid, or a longitudinal axis of the hearing aid. The first free end 56 and the second free end 58 are placed symmetrically with respect to the partition plane of the antenna 53. A shortest distance between the first segment 541 and the second segment 551 is between 1.5 mm and 6.5 mm. For example, a distance between the first free end 56 and the second free end 58 is is between 1.5 mm and 6.5 mm.

Figure 6A:
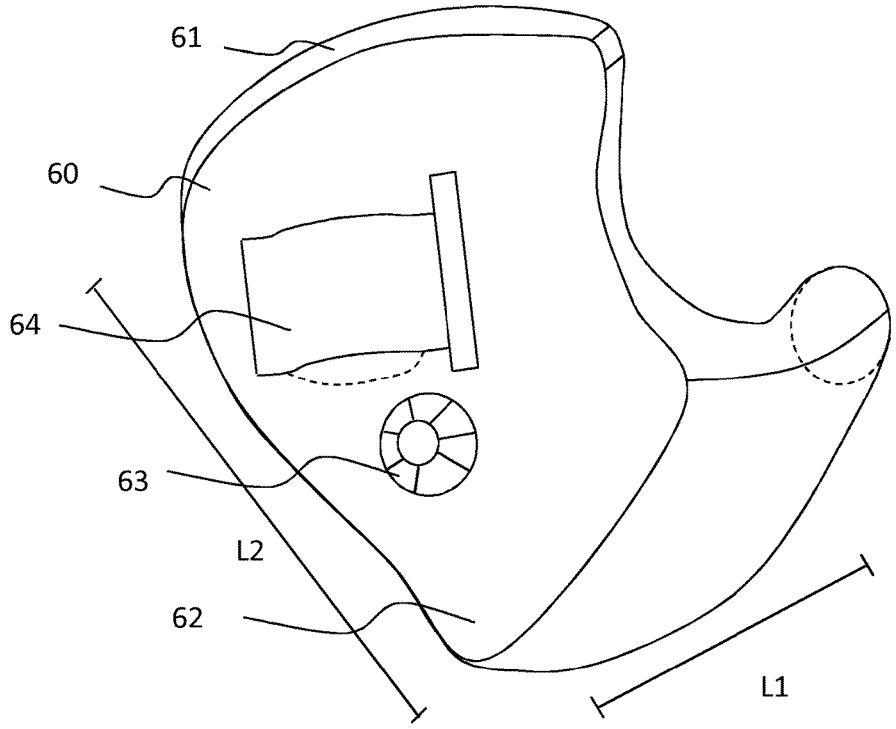
FIG. 6*a* shows an exemplary in-the-ear hearing aid.

FIG. 6*a* shows an exemplary in-the-ear hearing aid 60 according to this disclosure. The shell 61 of the hearing aid 60 is customized to the ear of the user. The hearing aid 60 comprises a front plate 62.The front plate 62 has a button 63 for turning the volume up and down and a battery door 64 that can be opened for removing and/or inserting a battery. The deep end of the hearing aid goes a little into the ear canal. The depth of the hearing aid 60 is measured from the front plate to the deepest end, such as along length L1. The width is measured as the width of the front plate, such as along length L2. For large ITE devices the width is often greater than the depth. Thereby, the ITE axis may not correspond to the longitudinal axis of the hearing aid.

Figure 6B:
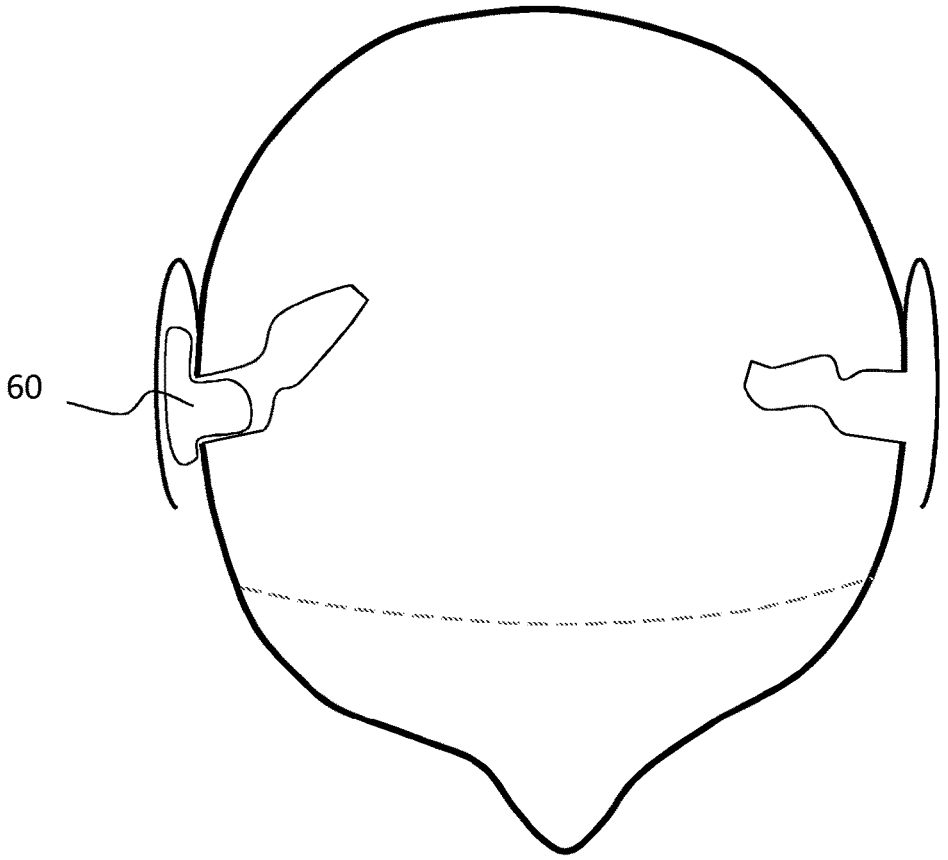
FIG. 6*b* shows a head seen from above with an in-the-ear hearing aid place in the right ear of the head.

FIG. 6*b* shows a head seen from above with an in-the-ear hearing aid 60 place in the right ear of the head. A part of the ITE hearing 60 goes into the ear canal of the right ear.

Figure 7A:
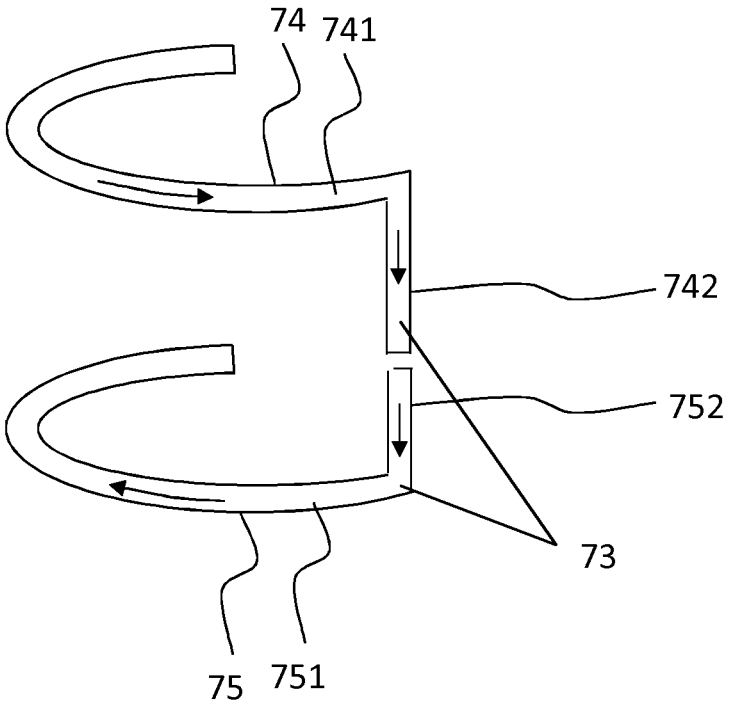
FIG. 7*a* shows schematically a direction of a current flowing in an exemplary antenna of a hearing aid.

FIG. 7*a* shows schematically a direction of the current flowing in an exemplary antenna 73 of a hearing aid according to the present disclosure. The antenna 73 comprises a first branch 74 and a second branch 75. The first branch 74 comprises a first segment 741 and a second part 742. The second branch 75 comprises a second segment 751 and a second part 752. The first branch 74 has a first segment 741 which extends in a first plane. The second branch 75 has a second segment 751 which extends in a second plane. The first plane and the second plane are parallel within +/−20 degrees. The first segment 741 has a geometry relative to the second segment 751 such that the first segment 741 is a mirror of the second segment 751.

A current flowing in the first segment 741 has a direction that is opposite to a direction of current flowing in the second segment 751. The antenna 73 is fed such that the current in the first branch 74 will be out of phase with the current in the second branch 75, preferably 180 degrees out of phase. With an appropriate geometry of the first segment 741 and the second segment 751, the sum of the current in the first segment 741 and the current in the second segment 751 will be substantially zero. If the first segment 741 and the second segment 751 are relatively close and the current flowing in the first segment 741 in opposite direction to the current flowing in the second segment 751 has an amplitude equivalent to the amplitude of the current in the second segment 751, an electromagnetic field radiated by the first segment 741 may be thereby substantially cancelled by an electromagnetic field radiated by the second segment 751. A current flowing in the second part 742 has a direction that is the same as a direction of current flowing in the second part 752. The direction of the currents flowing in second parts 742 and 752 is orthogonal to the surface of the head of a user when the hearing aid is worn in its operational position on the head of a user. In an in-the-ear type hearing aid, the currents flowing in the second parts 742 and 752 extending from the first plane and from the second plane towards the respective feed points flow in a direction orthogonal to a face plate of the in-the-ear type hearing aid. Currents flowing in the parts of the antenna 73 in a direction orthogonal to the first plane and/or the second plane (or orthogonal to the surface of the head, e.g. 742, 752) contribute significantly to the electromagnetic field radiated by the antenna 73. The part 742, 752 of the antenna extending orthogonally to the first plane and/or the second plane are orthogonal to the surface of the head. This part 742, 752 of the antenna contributes to an electromagnetic field that travels around the head of the user thereby providing a wireless data communication that is robust and has low loss.

Figure 7B:
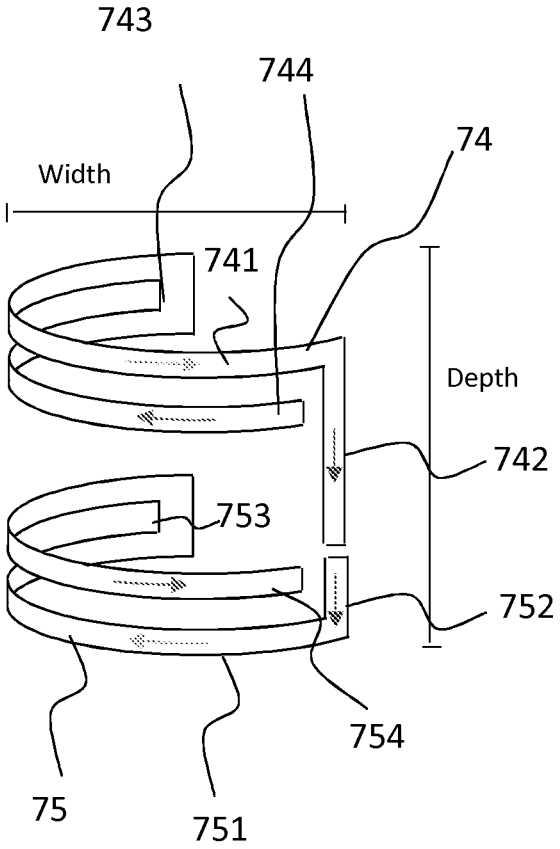
FIG. 7*b* shows schematically a direction of a current flowing in another exemplary antenna of a hearing aid.

FIG. 7*b* shows schematically a direction of the current flowing in another exemplary antenna 73 of a hearing aid according to the present disclosure. The antenna 73 comprises a first branch 74 and a second branch 75. The first branch 74 comprises a first segment 741, an additional part 742, a third segment 743, and a fourth segment 744, segments 743 and 744 forming a bend. The second branch 75 comprises a second segment 751, an additional part 752, a third segment 753, and a fourth segment 754. Segments 753 and 754 form a bend. A current flowing in the first segment 741 has a direction that is opposite to a direction of current flowing in the second segment 751. A current has direction illustrated with arrows in FIG. 7*b*. A current flowing in the segment 744 of the first branch has a direction that is opposite to a direction of current flowing in the segment 754 of the second branch. An electromagnetic field radiated by the first segment 741 may be thereby substantially cancelled by an electromagnetic field radiated by the second segment 751. Additionally, a current flowing in the first segment 741 has a direction that is opposite to a direction of current flowing in the segment 744.

A magnitude of a current flowing through the additional part 742, 752 is high compared to a magnitude of a current flowing through the fourth segment 744, 754. A magnitude of a current flowing through the first segment 741, 751 is between the magnitude of the current in part 742, 752 and the magnitude of the current in the fourth segment 744, 754. Because of the different magnitudes of the current in the first turn formed by segment 741 and part 742 and the current in the second turn 72 formed by segments 743 and 744, a sum of the currents in the two turns will not equal zero. However, a sum of the currents in the first segment 741 of the first branch 74 with the currents in the second segment 751 of the second branch 75 is substantially equal to zero.

Figure 8:
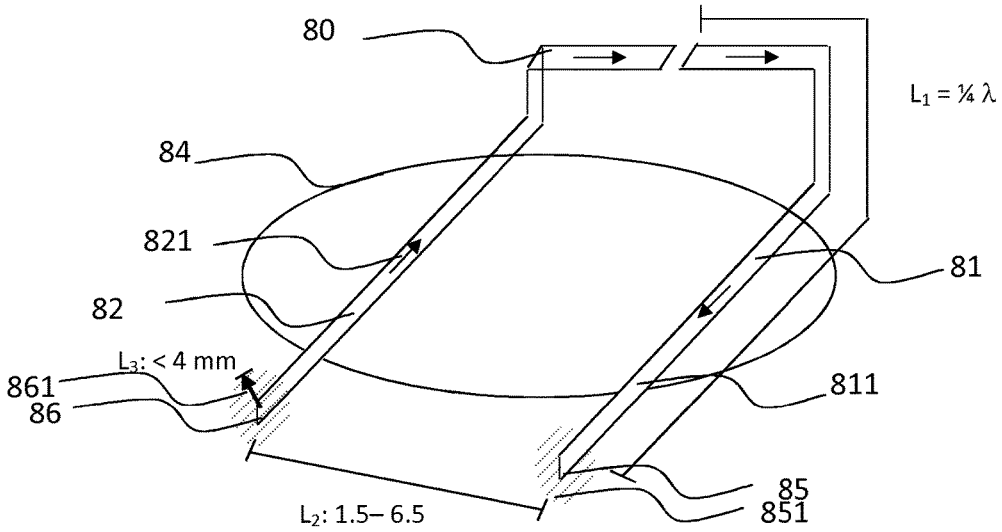
FIG. 8 shows schematically an exemplary antenna structure for a hearing aid according to the present disclosure.

FIG. 8 shows schematically an exemplary antenna structure 80 for a hearing aid according to the present disclosure. The antenna structure 80 comprises a first branch 81 and a second branch 82. A length L1 of the first branch 81 is a quarter of a wavelength of the electromagnetic field emitted by the antenna 80. Additionally or alternatively, a length of the second branch 82 is a quarter of a wavelength of the electromagnetic field emitted by the antenna 80. A difference between a length of the first branch 81 and a length of the second branch 82 may be less than a threshold, such as 25%, such as 10%, such as 0%. A shortest distance between the first segment 811 and the second segment 821, such as the distance L2 between the first free end 85 and the second free end 86, is between 1.5 mm and 6.5 mm. The first free end 85 is in a first circular area 851 with a first radius. The second free end plane 86 is in a second circular area 861 with a second radius. A radius L3 of the first circular area 851 or of the second circular area 861 is less than 4 mm, such as less than 3.5 mm, such as less than 3 mm. An integral of currents crossing area 84 will be substantially equal to zero. An electric density over the area 84 is negligible.

In one or more embodiments, the antenna and/or the wireless communication unit are comprised in a substrate.

The substrate allows bending the antenna to fit inside the hearing aid. A first segment of the first branch of the antenna may be placed on a first side of the substrate while another segment of the first branch of the antenna may be placed on a second side of the substrate. Additionally or alternatively, a second segment of the second branch of the antenna may be placed on a first side of a substrate while another segment of the second branch of the antenna may be placed on a second side of the same substrate.

The use of the terms "first", "second", and the like does not imply any particular order, but they are included to identify individual elements. Moreover, the use of the terms first, second, etc. does not denote any order or importance, but rather the terms first, second, etc. are used to distinguish one element from another. Note that the words first and second are used here and elsewhere for labelling purposes only and are not intended to denote any specific spatial or temporal ordering. Furthermore, the labelling of a first element does not imply the presence of a second element.

Although particular embodiments have been shown and described, it will be understood that it is not intended to limit the claimed inventions to the preferred embodiments, and it will be obvious to those skilled in the art that various changes and modifications may be made without departing from the spirit and scope of the claimed inventions. The specification and drawings are, accordingly, to be regarded in an illustrative rather than restrictive sense. The claimed inventions are intended to cover alternatives, modifications, and equivalents

The invention claimed is:

1. A hearing aid comprising an assembly, the assembly comprising:

a microphone for reception of sound and conversion of the received sound into a corresponding first audio signal;

a signal processor for processing the first audio signal into a second audio signal compensating a hearing loss of a user of the hearing aid;

a wireless communication unit configured for wireless communication; and a housing configured to accommodate the wireless communication unit;

an antenna configured for electromagnetic field emission and/or electromagnetic field reception, the antenna comprising:

a first feed point connected to the wireless communication unit, a second feed point, a first branch connected to the first feed point, the first branch comprising a first segment and a first free end, wherein at least a part of the first segment extends in a first plane, and a second branch connected to the second feed point, the second branch comprising a second segment and a second free end, wherein at least a part of the second segment extends in a second plane that is different from the first plane, wherein the second plane is between the wireless communication unit and the first plane.

2. The hearing aid according to claim 1, wherein at least a first part of the first branch is parallel to at least a first part of the second branch, and/or wherein the at least part of the first segment is parallel to the at least part of the second segment.

3. The hearing aid according to claim 1, wherein a current flowing in the first segment has a direction that is opposite to a direction of current flowing in the second segment.

4. The hearing aid according to claim 1, wherein the antenna has a partition plane, wherein a part of the first branch extending from the first plane to the first feed point is orthogonal to the partition plane; and/or wherein a part of the second branch extending from the second plane to the second feed point is orthogonal to the partition plane.

5. The hearing aid according to claim 4, wherein the first free end is located across from the second free end with respect to the partition plane.

6. The hearing aid according to claim 1, wherein the antenna has a third plane comprising the first feed point and the second feed point, wherein the first segment and/or the second segment does not intersect the third plane.

7. The hearing aid according to claim 6, wherein the third plane does not comprise the first free end and/or the second free end.

8. The hearing aid according to claim 1, wherein the second feed point is connected to a ground plane.

9. The hearing aid according to claim 1, further comprising a face plate, wherein at least a part of the first branch and/or at least a part of the second branch is positioned adjacent the face plate.

10. The hearing aid according to claim 9, wherein a part of the face plate extends in a front plane, and wherein the first plane and/or the second plane is parallel with the front plane.

11. The hearing aid according to claim 10, wherein a part of the first branch is orthogonal to the front plane, and/or a part of the second branch is orthogonal to the front plane.

12. The hearing aid according to claim 1, wherein the first branch comprises one or more bends, and/or the second branch comprises one or more bends.

13. The hearing aid according to claim 1, wherein a shortest distance between the first segment and the second segment is between 1.5 mm and 6.5 mm.

14. The hearing aid according to claim 1, wherein the hearing aid is an in the ear type hearing aid.

15. The hearing aid according to claim 1, wherein the hearing aid is a behind-the-ear hearing aid.

16. The hearing aid according to claim 15, wherein the first plane and/or the second plane is substantially parallel to a longitudinal side of the hearing aid.

17. The hearing aid according to claim 1, wherein both the first free end of the first segment and the second free end of the second segment are located in the housing, and wherein a majority of the first segment has a first rectilinear or curvilinear configuration, and a majority of the second segment has a second rectilinear or curvilinear configuration.

18. A hearing aid comprising an assembly, the assembly comprising:

a microphone for reception of sound and conversion of the received sound into a corresponding first audio signal;

a signal processor for processing the first audio signal into a second audio signal compensating a hearing loss of a user of the hearing aid;

a wireless communication unit configured for wireless communication; and a housing configured to accommodate the wireless communication unit;

an antenna configured for electromagnetic field emission and/or electromagnetic field reception, the antenna comprising:

a first feed point connected to the wireless communication unit, a second feed point, a first branch connected to the first feed point, the first branch comprising a first segment and a first free end, wherein at least a part of the first segment extends in a first plane, and a second branch connected to the second feed point, the second branch comprising a second segment and a second free end, wherein at least a part of the second segment extends in a second plane, wherein the antenna with the first branch and the second branch is accommodated in the housing, and wherein the housing is configured for placement in an ear canal of the user.

* * * * *